US008752667B2

(12) United States Patent
McKnight et al.

(10) Patent No.: US 8,752,667 B2
(45) Date of Patent: Jun. 17, 2014

(54) HIGH BANDWIDTH ANTIRESONANT MEMBRANE

(71) Applicant: HRL Laboratories LLC, Malibu, CA (US)

(72) Inventors: Geoffrey P. McKnight, Los Angeles, CA (US); Chia-Ming Chang, Agoura Hills, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 13/645,250

(22) Filed: Oct. 4, 2012

(65) Prior Publication Data

US 2013/0087407 A1 Apr. 11, 2013

Related U.S. Application Data

(60) Provisional application No. 61/544,195, filed on Oct. 6, 2011.

(51) Int. Cl.
*E04B 1/343* (2006.01)

(52) U.S. Cl.
USPC ..... 181/287; 181/286; 181/284; 181/207

(58) Field of Classification Search
USPC ..... 181/287, 284, 286, 207
See application file for complete search history.

(56) References Cited

U.S. PATENT DOCUMENTS

| | | | | |
|---|---|---|---|---|
| 2,541,159 | A * | 2/1951 | Geiger | 181/208 |
| 4,149,612 | A | 4/1979 | Bschorr | |
| 4,325,461 | A | 4/1982 | Bschorr | |
| 4,373,608 | A * | 2/1983 | Holmes | 181/202 |
| 5,587,564 | A * | 12/1996 | Stief et al. | 181/295 |
| 5,851,626 | A | 12/1998 | McCorry et al. | |
| 7,249,653 | B2 | 7/2007 | Sheng et al. | |
| 7,263,028 | B2 | 8/2007 | Thomas et al. | |
| 7,395,898 | B2 * | 7/2008 | Yang et al. | 181/286 |
| 7,510,052 | B2 | 3/2009 | Ayle | |
| 7,895,803 | B2 * | 3/2011 | Downey et al. | 52/511 |
| 8,162,104 | B2 * | 4/2012 | Bastion et al. | 181/284 |
| 2002/0046901 | A1 * | 4/2002 | Zapfe | 181/206 |
| 2005/0279574 | A1 | 12/2005 | Halterbeck et al. | |
| 2006/0065474 | A1 | 3/2006 | Niwa et al. | |
| 2008/0085020 | A1 | 4/2008 | Tsai et al. | |
| 2008/0099609 | A1 | 5/2008 | Drost | |
| 2009/0233045 | A1 | 9/2009 | Slama et al. | |
| 2011/0067952 | A1 * | 3/2011 | Oxenknecht et al. | 181/284 |

FOREIGN PATENT DOCUMENTS

| | | |
|---|---|---|
| JP | 2006-098966 | 4/2006 |
| JP | 2009-535667 | 10/2009 |
| KR | 20-1999-0025038 | * 7/1999 |

* cited by examiner

*Primary Examiner* — Forrest M Phillips
(74) *Attorney, Agent, or Firm* — Janus Law Group

(57) ABSTRACT

A membrane is disclosed. The membrane contains a first weight disposed at a center portion of the membrane, and a first hinge structure disposed away from the center portion of the membrane.

24 Claims, 19 Drawing Sheets

HIGH BANDWIDTH ANTIRESONANT MEMBRANE

CROSS REFERENCE TO RELATED APPLICATIONS

This application claims the benefit of U.S. Provisional Application No. 61/544,195, filed on Oct. 6, 2011, which is incorporated herein by reference in its entirety.

FIELD

The present invention relates to structural acoustic barriers and more particularly to antiresonant membranes.

BACKGROUND

Noise has long been regarded as a harmful form of environmental pollution mainly due to its high penetrating power. Current noise shielding solutions are directly tied to the mass of the barrier. In general, noise transmission is governed by the mass density law, which states that the acoustic transmission T through a wall is inversely proportional to the product of wall thickness l, the mass density ρ, and the sound frequency f. Hence doubling the wall thickness will only add (20 log 2=) 6 dB of additional sound transmission loss (STL), and increasing STL from 20 to 40 dB at 100 Hz would require a wall that is eight times the normal thickness.

Although a number of structures have been used to improve the STL, they have a limited effective bandwidth and their performance varies depending on the temperature and external distortions. Many instances require a material with high STL over a large bandwidth and tolerance of high environment variations.

The prior art discloses different approaches to achieving at least partial sound transmission losses. For example, U.S. Pat. No. 7,510,052 discloses a sound cancellation honeycomb based on modified Helmholtz resonance effect. U.S. Application 20080099609 discloses a tunable acoustic absorption system for an aircraft cabin that is tuned by selecting different materials and changing dimensions to achieve soundproofing for each position and specific aircraft. Unfortunately, the structures disclosed in U.S. Application 20080099609 are heavy and bulky. U.S. Pat. No. 7,263,028 discloses embedding a plurality of particles with various characteristic acoustic impedances in a sandwich with other light weight panels to enhance the sound isolation. Although it could be lighter or thinner than traditional solid soundproofing panels, it is still bulky and its soundproofing operating frequency is high which makes it less effective for low-frequency operation. U.S. Pat. No. 7,249,653 discloses acoustic attenuation materials that comprise an outer layer of a stiff material which sandwiches other elastic soft panels with an integrated mass located on the soft panels. By using the mechanical resonance, the panel passively absorbs the incident sound wave to attenuate noise. This invention has a 100 Hz bandwidth centered around 175 Hz and is not easily tailored to various environmental conditions. U.S. Pat. Nos. 4,149,612 and 4,325,461 disclose silators. A silator is an evacuated lentiform (double convex lens shape) with a convex cap of sheet metal. These silators comprise a compliant plate with an enclosed volume wherein the pressure is lower than atmospheric pressure to constitute a vibrating system for reducing noise. To control the operating frequency, the pressure enclosed in the volume coupled with the structural configuration determines the blocking noise frequency. The operating frequency dependence on the pressure in the enclosed volume makes the operating frequency dependent on environment changes such as temperature. U.S. Pat. No. 5,851,626 discloses a vehicle acoustic damping and decoupling system This invention includes a bubble pack which may be filled with various damping liquids and air to enable the acoustic damping. It is a passive damping system dependent on the environment. Finally, U.S. Pat. No. 7,395,898 discloses an antiresonant cellular panel array based on flexible rubbery membranes stretched across a rigid frame. However, the materials disclosed in U.S. Pat. No. 7,395,898 limit the bandwidth to about 200 Hz and a single attenuation frequency.

Embodiments disclosed in the present disclosure overcome the limitations of the prior art and provide improved STL.

SUMMARY

According to a first aspect, a membrane is disclosed. The membrane comprises: a first weight disposed at a center portion of the membrane; and a first hinge structure disposed away from the center portion of the membrane.

According to a second aspect, a structure is disclosed. The structure comprising: a first plurality of membranes, wherein each membrane comprises: a first weight disposed at a center portion of the membrane; a first hinge structure disposed away from the center portion of the membrane; and a first frame coupling the first plurality of the membranes.

According to a third aspect a method is disclosed. The method comprising: providing a membrane; forming a first hinge structure disposed away from a center portion of the membrane, wherein resonant frequency of the membrane depends on length, thickness, elastic modulus, or Poisson ratio of the first hinge structure.

According to a forth aspect, a membrane is disclosed. The membrane comprises: a first weight disposed at a center portion of the membrane; and one or more stiffening ribs extending away from a center portion of the membrane in a spoke pattern.

According to a fifth aspect, a membrane is disclosed. The membrane comprises: a first weight disposed at a center portion of the membrane; and a second weight disposed between the first weight and an outer portion of the membrane, wherein the second weight defines an opening and the first weight is disposed within the opening.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to describe various specific embodiments disclosed herein. One skilled in the art will understand that the presently claimed invention may be practiced without all of the specific details discussed below. In other instances, well known features have not been described so as not to obscure the invention.

Figure 1:
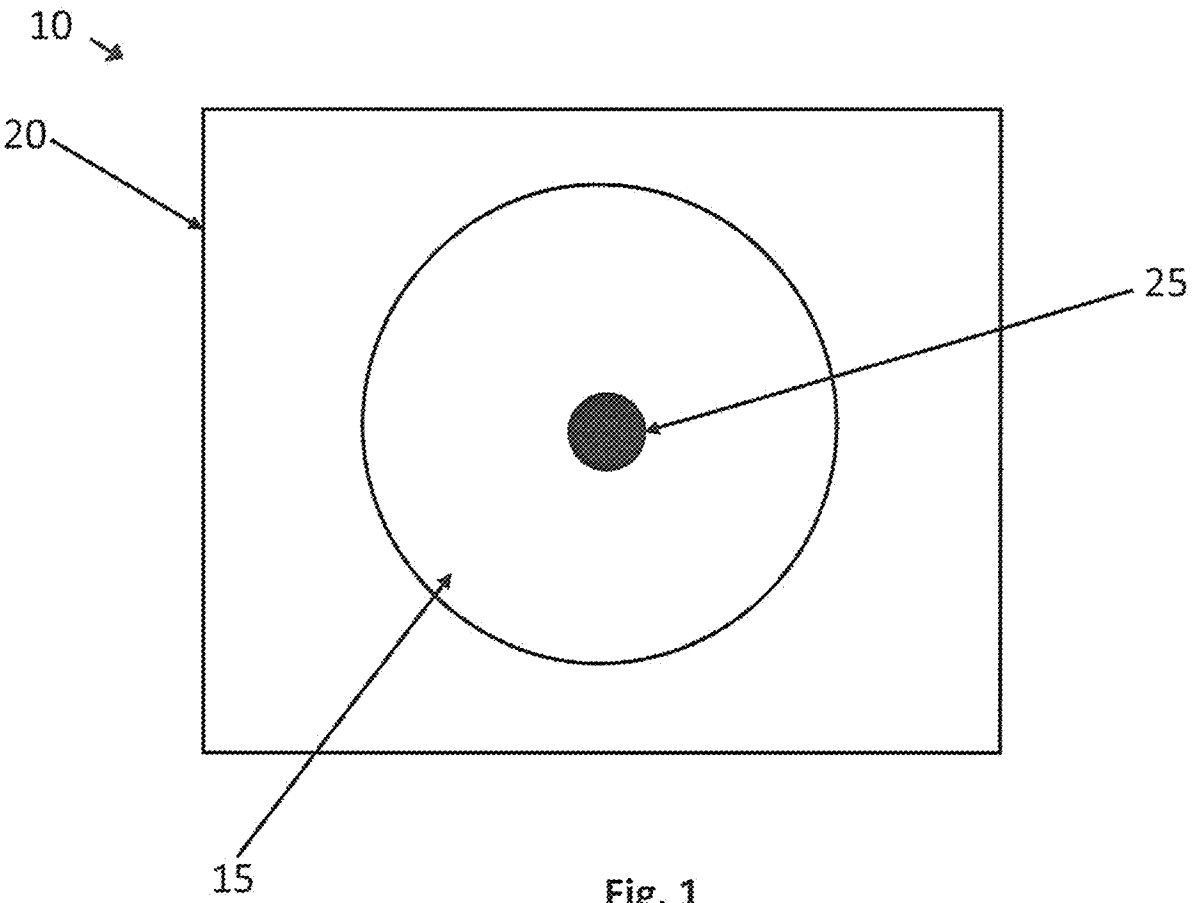
Fig. 1 Prior Art
FIG. 1 depicts a plan view of a prior art antiresonant membrane.

Referring to FIG. 1, as known in the prior art, a resonant membrane structure 10 composed of a rubbery membrane 15 affixed to a frame 20 with a weight 25 attached at the center of the rubbery membrane 15 has been used to improve the STL. The rubbery membrane exhibits significant changes in the transmission spectrum with changes in temperature, humidity, exposure to sunlight, solvents, and other environmental factors. Further, the membrane stiffness is determined solely by membrane tension which provides only a limited toolset to change the cell size, active frequency range, and susceptibility to temperature variations. What is needed is a more flexible design that allows preferred engineering materials such as hard plastics and metals to be used but still allow widely varying frequency ranges and cell sizes.

Figure 2:
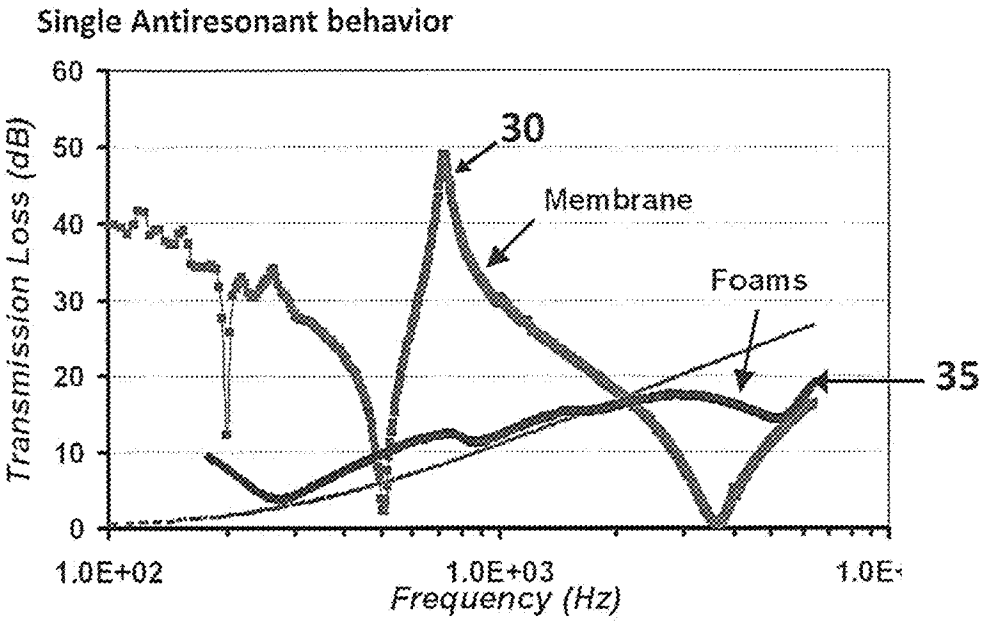
FIG. 2 depicts transmission characteristic of the antiresonant membrane in FIG. 1.

The antiresonant behavior of the membrane structure 10 is shown in FIG. 2. Curve 30 depicts the resonant membrane structure 10 undergoing a transmission loss test in an impedance tube setup. A pressure signal (typically random white noise) was applied on one side of the resonant membrane structure 10 and the through transmission was recorded using a series of 4 microphones that can calculate the phase, amplitude, and frequency of pressure energy and thus the loss of energy across the resonant membrane structure 10. Curve 35 depicts a foam material with the same surface density undergoing the same transmission loss test in an impedance tube setup. The trend of increasing transmission loss with frequency matches the mass law prediction which represents the conventional noise control approach relying on material mass. Although the resonant membrane structure 10 shows a decrease in transmission over a particular active band compared to traditional porous foam materials, the membrane structure 10 is limited to bandwidth of about 200 Hz and a single attenuation frequency.

The need for increased STL bandwidth, with greater control over the transmission spectra, and reduce dependence on environmental factors may be solved at least in part by the embodiments presently disclosed below.

Figure 3:
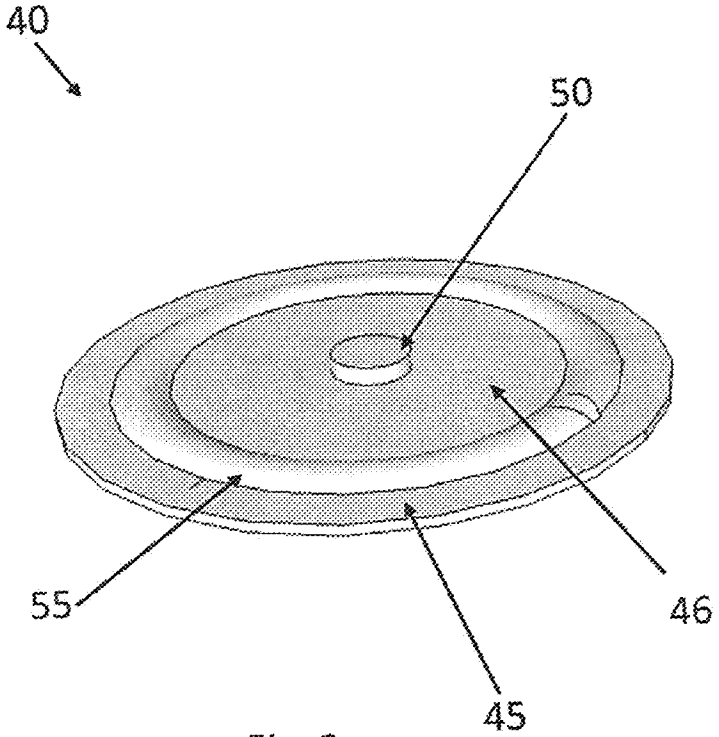
FIG. 3 depicts a perspective view of an antiresonant membrane according to the principles of the present invention.
Figure 5:
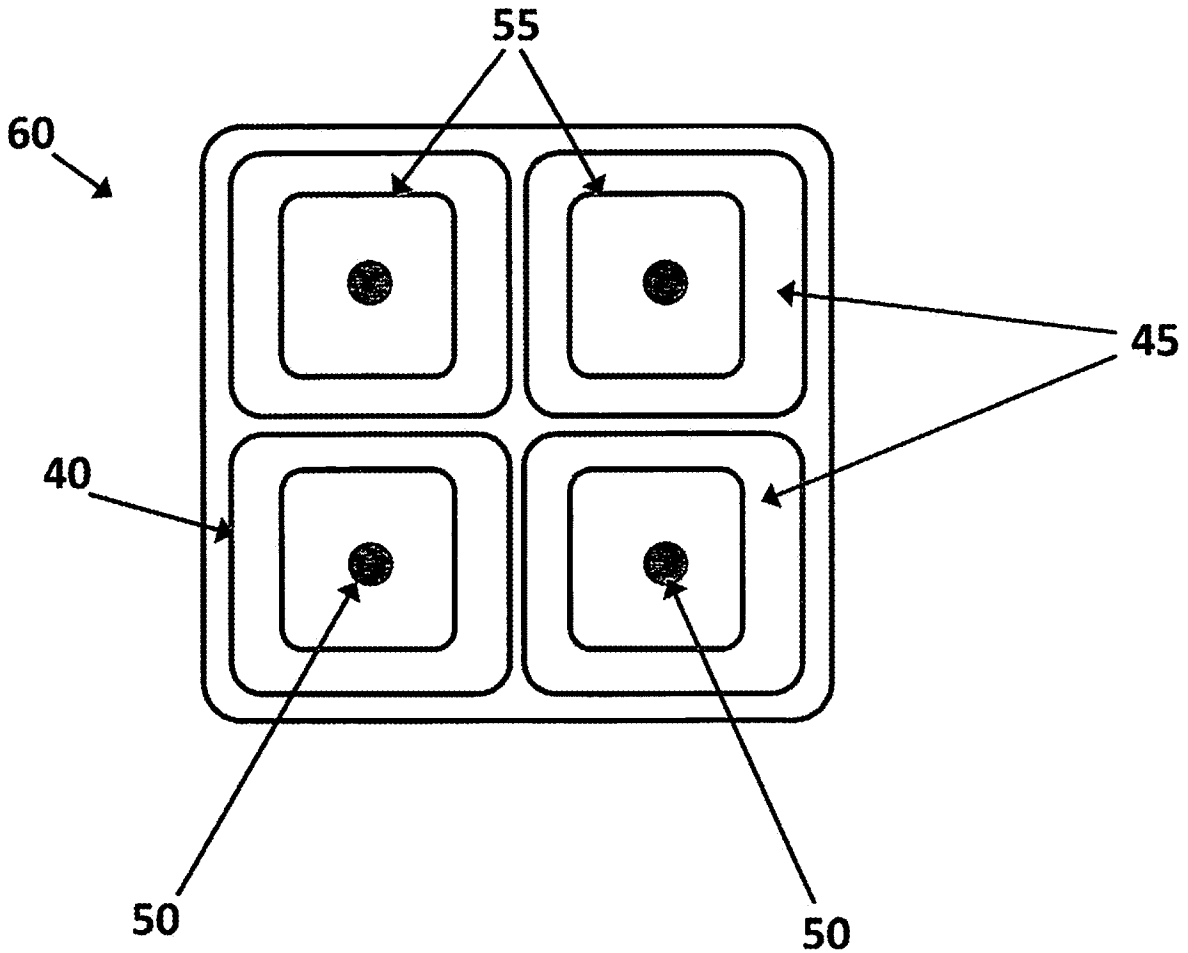
FIG. 5 depicts a plurality of antiresonant membranes assembled into a larger structure.

In one embodiment according to the present disclosure, referring to FIG. 3, a membrane structure 40 may comprise a first membrane 45 which may be affixed to a frame (not shown) and a second membrane 46 with a mass/weight 50 attached at or near the center of the membrane 46. The membrane structure 40 further comprises at least one hinge structure 55 disposed between the first membrane 45 and the second membrane 46. While FIG. 3 shows a generally circular membrane and structure, this is not to imply a limitation. Alternative geometries according to the principles of this invention are square, rectangular (as shown in FIG. 5), hexagonal and triangular membranes. In one embodiment, the membrane 45 and the membrane 46 comprise the same material(s) and/or thickness. In another embodiment, the membrane 45, the membrane 46 and the hinge structure 55 comprise the same material(s). In another embodiment, due to the shape (i.e. structure) of the hinge structure 55, the hinge structure may have different stiffness and/or may provide different response to external forces than membranes 45, 46 even if the membrane 45, the membrane 46 and the hinge structure 55 comprise the same material(s).

The hinge structure 55 allows the designer to decouple the response of the structure 40 from the system tension in membranes 45, 46 and allows the use of stiff, creep resistant materials for the membranes 45, 46. This improves scalability when large areas need to be acoustically isolated since the large area can be covered with as many smaller structures as needed. Scalability is also improved by using a plurality of structures 40 to reduce buckling and deformation across large numbers of cells assembled into an array, compared to an array of fewer but larger cells. In addition, the coupling between adjacent cells is reduced to allow the cells to better operate as independent cells.

In one embodiment, the hinge structure 55 is a bend dominated elastic component built into the surface of the membranes 45, 46 that creates a method to tune the stiffness and hence resonant frequency of the membrane structure 40 without using tension. The stiffness of the hinge structure 55 is controlled by the length and thickness parameters of the hinge structure 55, which can be thought of as, for example, a curved plate. Thus the stiffness is based on the elastic modulus, the Poisson ratio, and the thickness of the material(s) forming the hinge structure 55. In typical membranes, the tension component provides all bending resistance and thus defines the properties, independent of material selected. By tuning the thickness and height/width ratio of the hinge structure 55, the stiffness of the membrane structure 40 may be tuned. With the ability to adjust the stiffness of the membrane structure 40, the membrane structure 40 may have a very low frequency response by using stiff materials such as engineering thermoplastics and/or thermosets for the membranes 45, 46. These thermoplastics and thermosets exhibit very low creep that would change the behavior and performance and have great temperature stability advantageous for many engineering applications. In one embodiment, membranes 45, 46 may comprise Acrylonitrile butadiene styrene (ABS), Polycarbonates (PC), Polyamides (PA), Polybutylene terephthalate (PBT), Polyethylene terephthalate (PET), Polyphenylene oxide (PPO), Polysulphone (PSU), Polyetherketone (PEK), Polyetheretherketone (PEEK), Polyimides Polyphenylene sulfide (PPS), Polyoxymethylene plastic (POM), HDPE, LDPE, or nylon. It is to be understood that other materials may also be used for the membranes 45, 46. Without implying a limitation, membranes 45, 46 may comprise metals such as aluminum, brass and steel.

Figure 4:
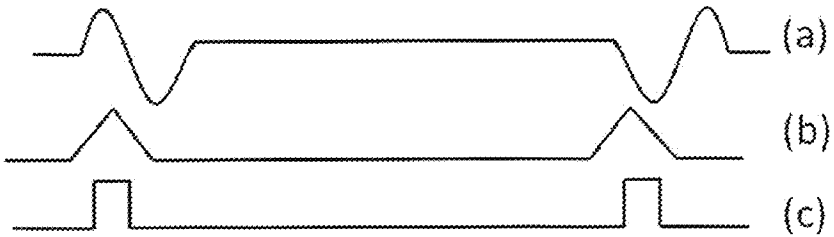
FIGS. 4*a-c* depict a cross section view of potential hinge structure mechanisms used in the embodiment of FIG. 3.

While the simple single hinge structure 55 is shown in FIG. 3, it is to be understood that the presently disclosed membrane structure may comprise two or more hinge structures 55 as shown in the cross section views of FIGS. 4*a*, 4*b*, and 4*c*. FIG. 3 depicts the hinge structure 55 with semi-circular profile, but without implying a limitation the shape of the hinge structure 55 may be a sine wave (FIG. 4*a*), triangular shape (FIG. 4*b*), square shape (FIG. 4*c*) or any other shape depending on the design requirements for stiffness and manufacturability.

In another embodiment, a plurality of structures 40 may be combined in to an array as shown in FIG. 5. Referring to FIG. 5, an array 60 comprises four membrane structures 40 with membranes 45, masses 50 and hinge structures 55. Note that the membranes 40 and the hinge structures 55 in FIG. 5 are not necessarily circular. The array 60 has been tested and exhibited good low frequency performance with resonant frequencies as low as 120 Hz from a 1" diameter membrane dimension. Without implying a limitation, lower frequencies may be generated by further thinning and extending the hinge structure 55.

Figure 6:
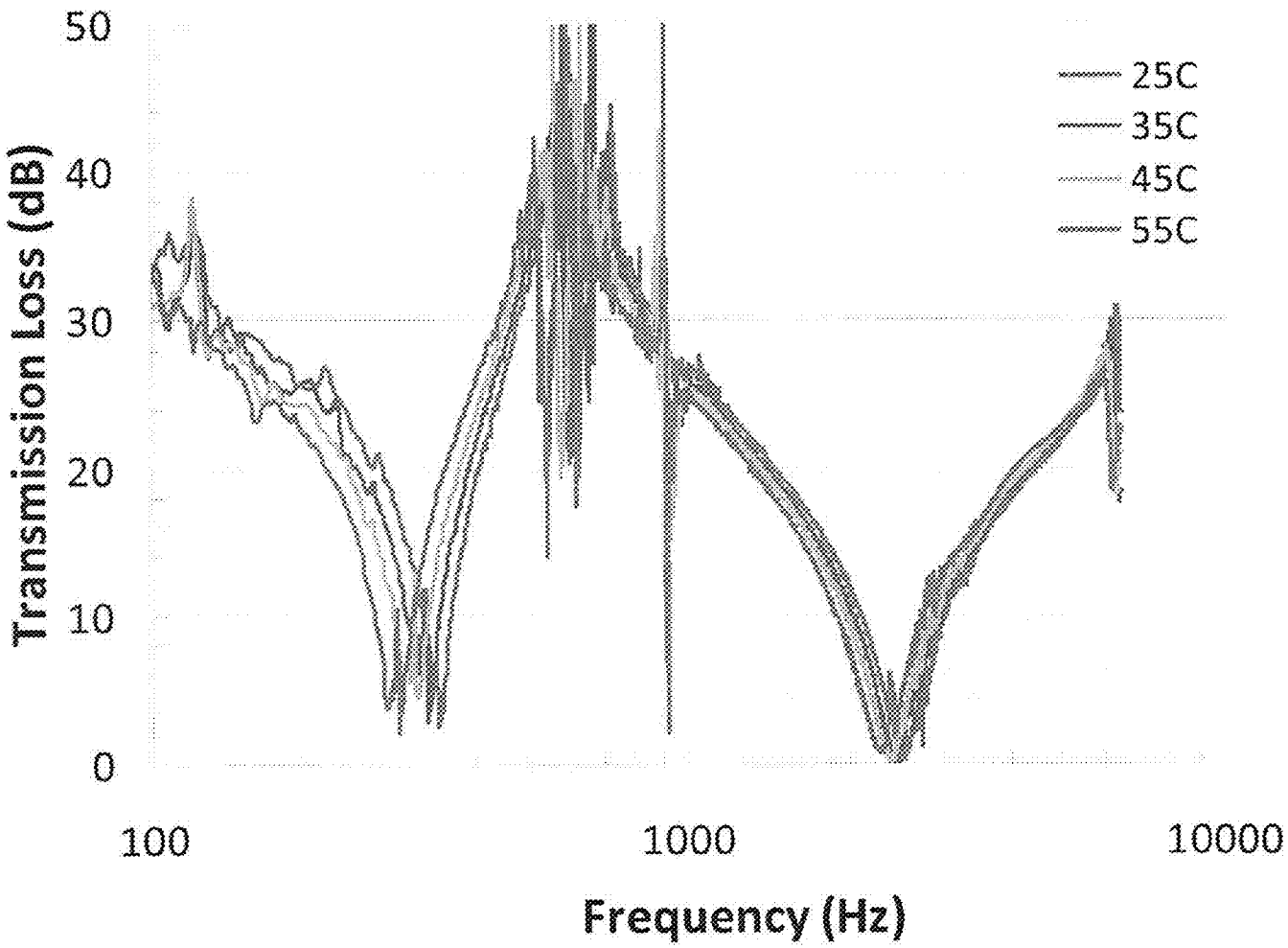
FIG. 6 depicts the variation in transmission of an antiresonant membrane according to the principles of the present invention as a function of temperature.

FIG. 6 shows the change in transmission spectra for the membrane structure 40 with 40° C. changes in temperature. As can be seen in FIG. 6, the shift in the performance of the membrane structure 40 is less than 5% over a 30° C. temperature change.

In one embodiment, the mass 50 in FIG. 3 may comprise iron alloys, brass alloys, aluminum, lead, ceramics, glass, stone, or other materials with high density. In another embodiment, the mass 50 may be shaped as a cylinder, cube or rectangular solid. To increase the size of the mass without influencing the length of the membrane, and without implying a limitation, the mass 50 may be in the form of a T shape, ring shape or irregular shapes depending on the desired requirements. The mass could couple to support structures with connecting materials, such as shape memory alloys or viscoelastic materials, to enable various resonating patterns.

Figure 7:
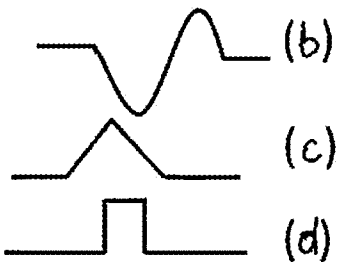
FIG. 7*a* depicts the embodiment of FIG. 3 with added membrane stiffeners.
FIGS. 7*b-d* depict a cross section view of potential membrane stiffeners mechanisms used in the embodiment of FIG. 7*a*.
Figure 7A:
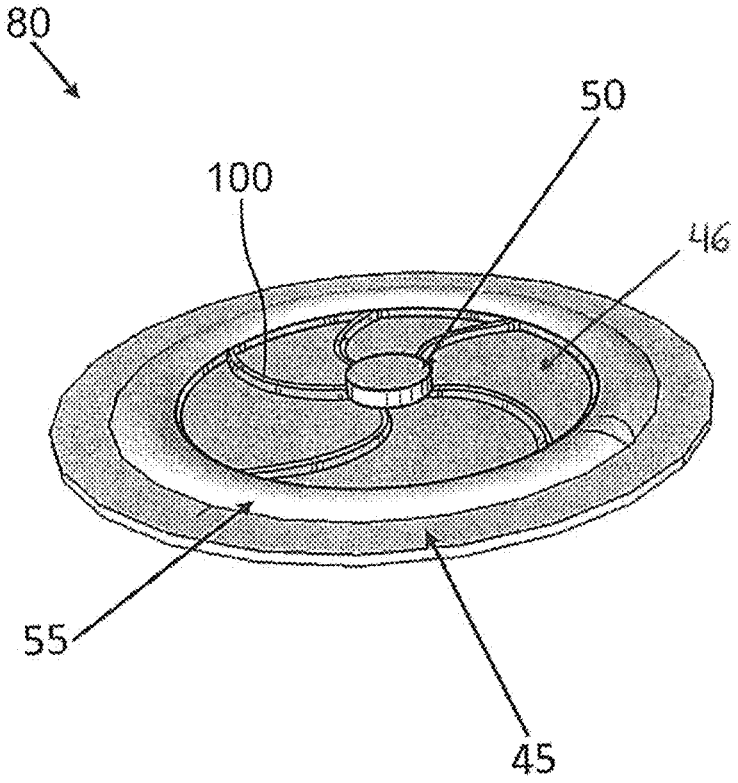

In another embodiment, referring to FIG. 7*a*, the membrane structure 80 may comprise a membrane 45 affixed to a frame around the perimeter of the membrane (not shown), a membrane 46 with a mass 50 attached at the center of the membrane 46, at least one hinge structure 55 disposed away from the center of mass 50 and one or more stiffening ribs 100. The stiffening ribs 100 may be used to control the spurious vibration modes in the membrane 46 while increasing the second resonance (membrane mode) to provide wider noise reduction bandwidth. The antiresonant effect is generated through the mixture of two center-symmetric modes (mass and membrane modes). Additional modes within this frequency range may diminish the transmission loss. Providing stiffening features 100 may diminish higher modes in the membrane 46 while minimally shifting the primary modes. Although FIG. 7*a* depicts the hinge structure 55, it is to be understood that the membrane structure 80 may be implemented without the hinge structure 55.

In one embodiment, the one or more stiffening features 100 are formed in the membrane 46. Referring to FIGS. 7*b-d*, but without implying a limitation, the shape of the stiffening feature 100 may be a sine wave (FIG. 7*b*), triangular shape (FIG. 7*c*), square shape (FIG. 7*d*) or any other shape depending on the design requirements for stiffness and manufacturability.

Figure 8:
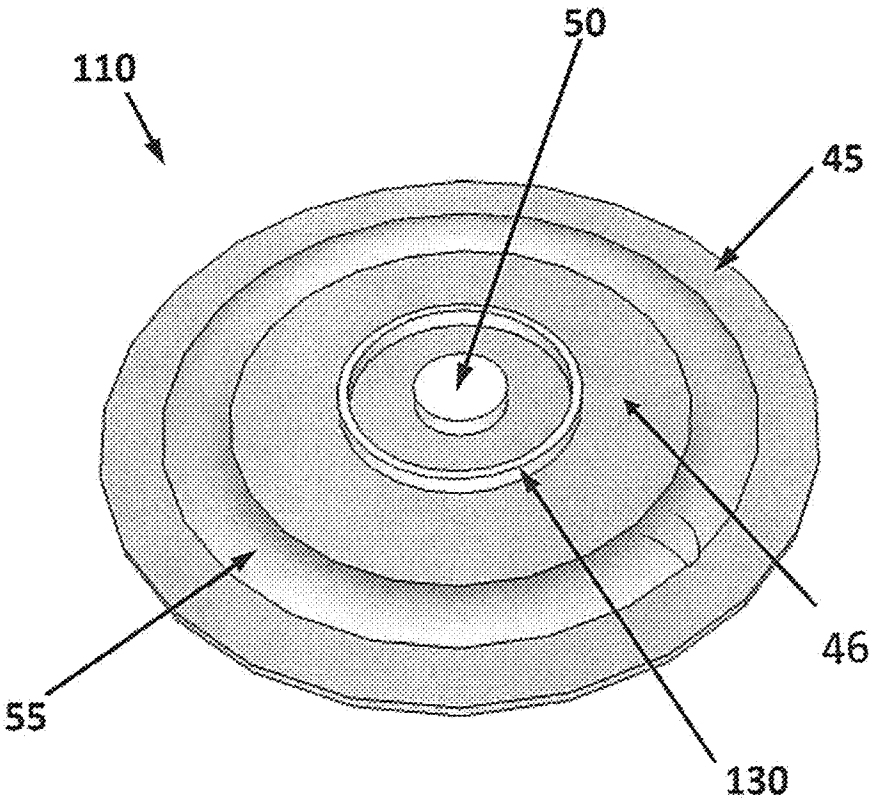
FIG. 8 depicts the embodiment of FIG. 3 with an added mass to provide a second resonance.

In another embodiment according to the present disclosure, referring to FIG. 8, a membrane structure 110 may comprise a membrane 45 affixed to a frame around the perimeter of the membrane (not shown), a membrane 46 with a first mass 50 attached at or near the center of the membrane 46, at least one hinge structure 55 disposed away from the center of the first mass 50 and at least one second mass 130 disposed away from the first mass 115. In one embodiment, the second mass 130 is shaped like a ring as shown in FIG. 8.

Figure 9:
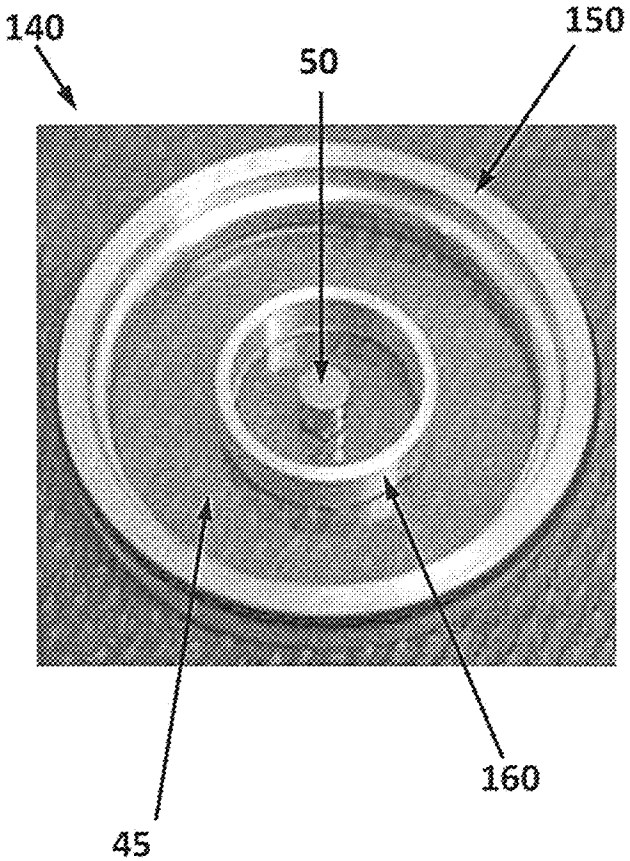
FIG. 9 depicts an alternative embodiment of the principles of this invention.

Referring to FIG. 9, in another embodiment, a membrane structure 140 may comprise a membrane 45 affixed to a frame 150 with a first mass 50 attached at the center of the membrane 45, and at least one second mass 160 disposed away from the first mass 50. In one exemplary embodiment, the second mass 160 is shaped like a ring as shown in FIG. 9. Unlike the membrane structure 110, the membrane structure 140 does not have the hinge structure 55 shown in FIG. 8.

Although FIGS. 8 and 9 show the ring shaped masses 130 and 160 on a single side of the membrane 45, it is to be understood that the ring shaped masses 130 and 160 may be placed on each side of the membrane 45. In one embodiment, the ring shaped mass 130 or 160 may be integrated into the membrane structures 110 and 140 through the fabrication process by adhesion, fusion bonding, and/or magnetism. In another embodiment, the ring shaped mass may be fabricated out of the same materials as the membrane 45 and molded as part of the membrane structure 110 or 140 when the membrane 45 is formed. It is to be understood that the center mass may be similarly integrated with the membrane structure 110 or 140.

Figure 10:
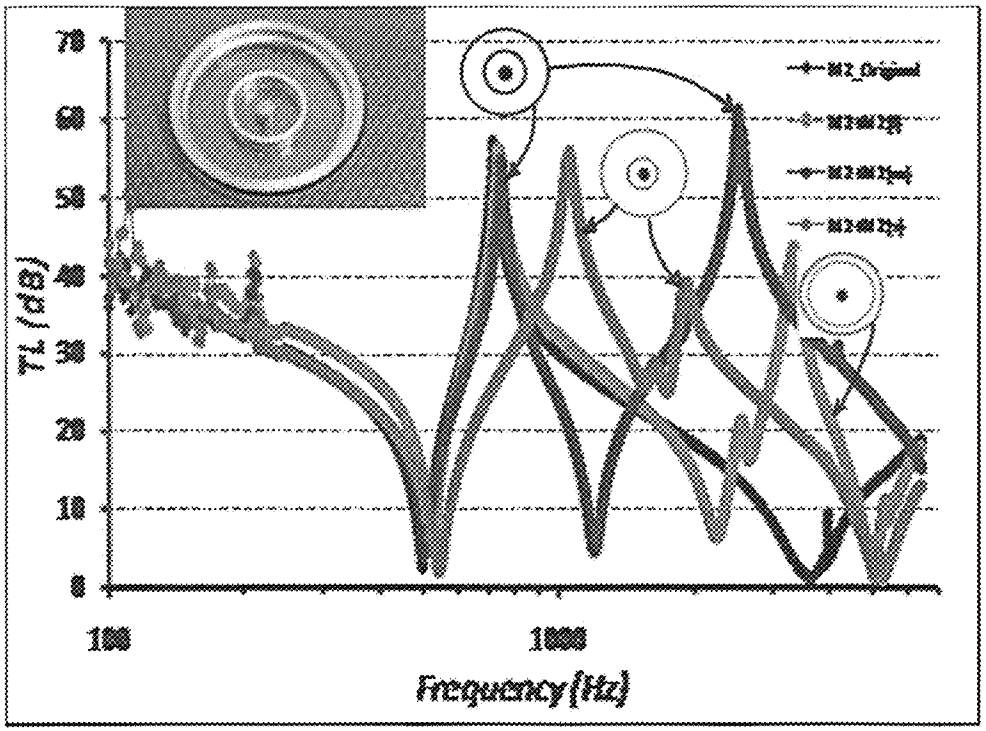
FIG. 10 depicts a transmission characteristic of the embodiment in FIG. 9.

The ring shaped mass 130 (shown in FIG. 8) and/or the ring shaped mass 160 (shown in FIG. 9) may be carefully tuned in diameter and mass to provide a second antiresonant peak. By tuning the parameters of the ring masses 130 and/or 160, a variety of different behaviors are possible. Three of these behaviors are shown in FIG. 10 for three different ring shaped masses 160 of different diameters. The graph in FIG. 10 shows an increase in effective bandwidth as well as strong antiresonant peaks when using two masses instead of one mass. The design of single ring mass also suppresses higher order vibrations providing the greatest level of transmission loss. It can be the lightweight solution for the same target noise frequency by increasing the membrane stiffness with the larger ring mass. The ring mass can also be used to provide wider bandwidth with larger dimension which shortens the membrane length and thus increases the second resonance frequency (membrane mode).

The dimensions of the ring shaped mass may be optimized according to the required behavior. In one exemplary embodiment, a ring shaped mass may have mass ratios between 0.25 and 10 times the central mass. In another exemplary embodiment, the diameter of the ring shaped mass may be between 0.85 and 0.2 of the membrane diameter. Where the membrane is a rectangular shape, the diameter of the ring shaped mass may be between 0.85 and 0.2 the longest dimension of the membrane.

While circular membrane 45 is shown for illustration purposes in FIGS. 3, 7 and 8 respectively, it is to be understood that other geometries may be used. For example, membrane 45 may be square, triangular, hexagonal, or any other shape depending on the desired performance. In one embodiment, the second mass 130 and/or 160 may about the same shape as the shape of the membrane 45. In another embodiment, the shape of the second mass 130 and/or 160 may be different from the overall shape of the membranes 45 to aid establishing a particular frequency response or acoustic energy absorption spectrum. The ring shaped mass may similarly to formed into various area-enclosing designs rather than strictly circular rings. Square, ellipsoid, star shaped, or other similar shapes may be used. In additional, while the ring is shown to be continuous around its perimeter, a series of discrete masses may also be used to form the ring.

In another embodiment, the membrane structure 110 (shown in FIG. 8) and/or 140 (shown in FIG. 9) may comprise one or more additional masses (not shown) so that additional antiresonant peaks can be achieved.

Figure 11:
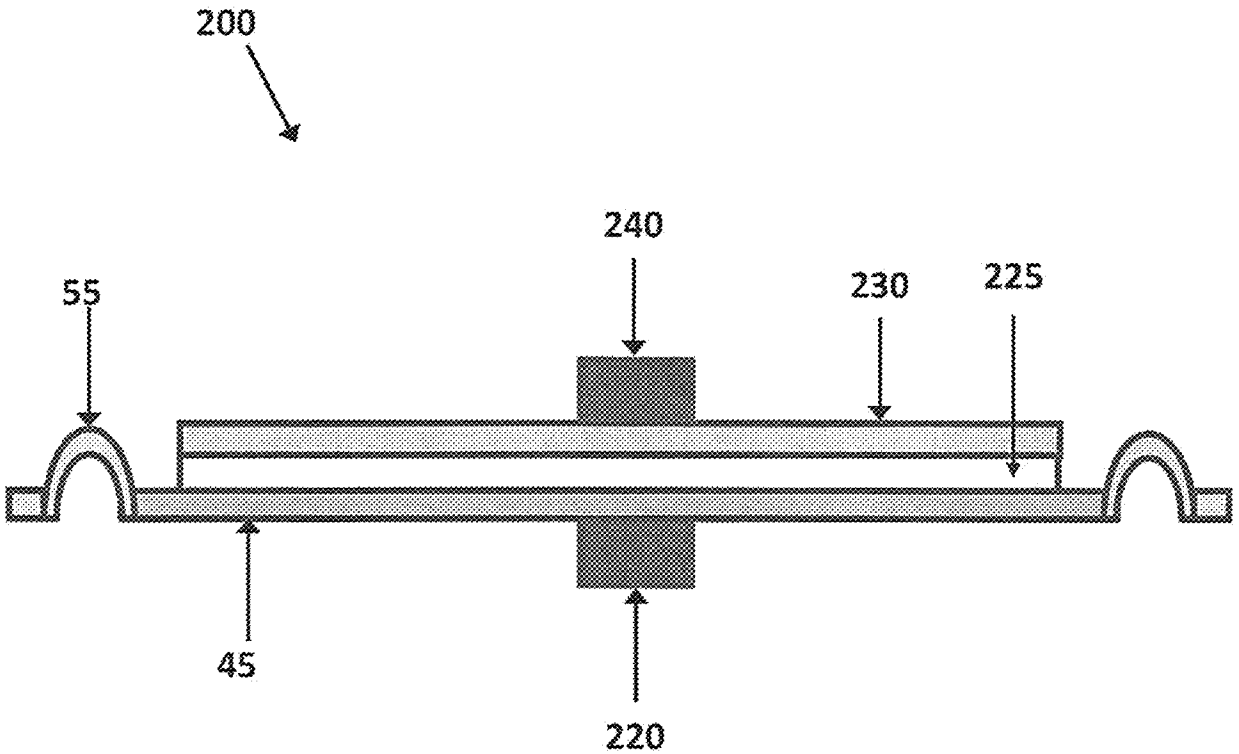
FIG. 11 depicts an alternative embodiment of the principles of this invention.

In another embodiment, a viscoelastic material 225 may be included in the membrane structure(s) presently disclosed to control the transmission and also to alter the transmission loss spectra. Referring to FIG. 11 showing a cross section view, a membrane structure 200 may comprise a membrane 45 affixed to an optional frame (not shown) with a first mass 220 attached at the center of the membrane 45, at least one hinge structure 55 disposed away from the center of the first mass 220, a viscoelastic material 225 sandwiched between the membrane 220 and a cover layer 230. In one embodiment, the viscoelastic material 225 may be between 0.1× and 4× thickness of the membrane 45. The cover layer 230 may be of equal or higher stiffness as the membrane 45 with the ratio of the cover layer 230 to membrane 45 stiffness varying between 0.5 and 100. Depending on the stiffness, the thickness of the cover layer 230 may vary between 1× and 0.01× the membrane 45 thickness. In another embodiment, the membrane structure 200 may also comprise a second mass 240 disposed on the cover layer 230.

Figure 12:
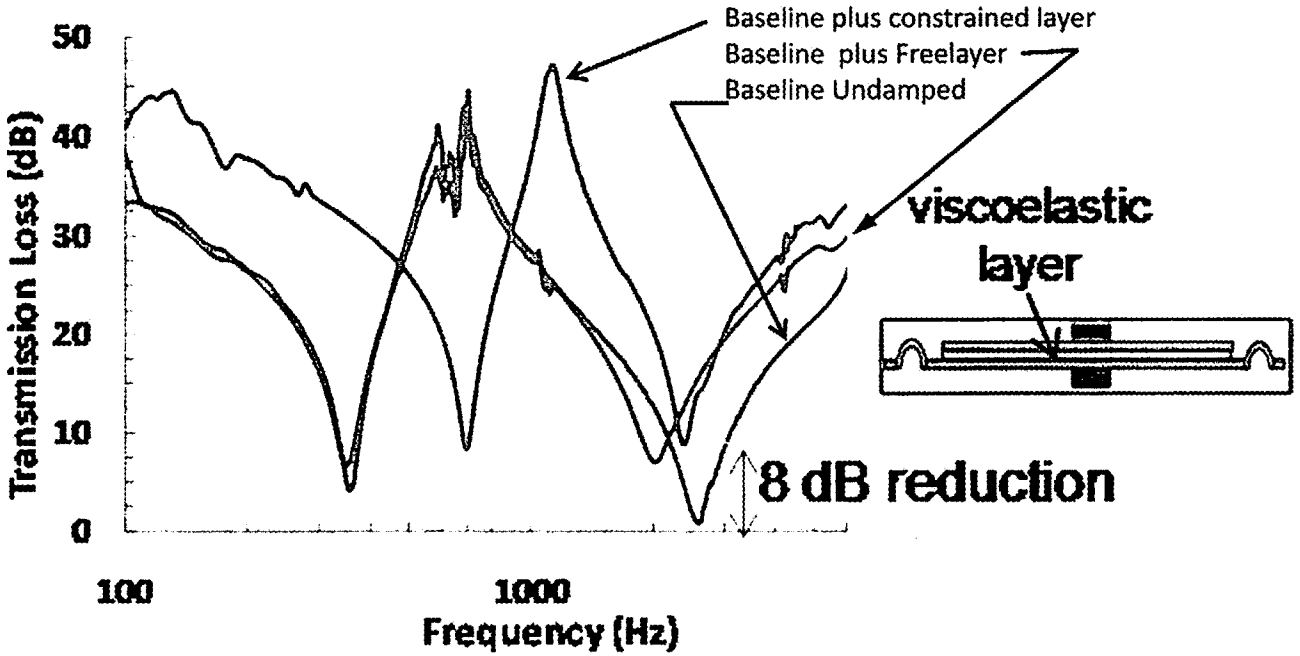
FIG. 12 depicts the transmission characteristic of the embodiment in FIG. 11.

Referring to FIG. 12, the acoustic energy transmission spectrum of the mass and membrane structure 200 (Baseline plus Constrained Layers) in FIG. 11 has been reduced by 8 dB as compared to the control sample (Baseline Undamped). This is a significant reduction in the peak energy transmission without a significant decrease in the antiresonance (peak transmission loss) frequency. Although the addition of damping materials reduces the transmission loss magnitude (lower quality factor), it could broaden the bandwidth of the noise reduction bandwidth.

A second variation of this concept is the use of viscoelastic material 225 (shown in FIG. 11) as a frequency sensitive material. As an example, shear thickening fluids and gels have behavior that changes from low viscosity to nearly solid depending on the strain rate. Using this material in a constrained layer configuration with a cover layer as shown in FIG. 11 will allow the stiffness of the membrane to be modulated based on the frequency. Ultimately, this allows a greater bandwidth to be achieved since at low frequencies the constrained layer 225 does not contribute to the primary mode keeping it relatively low. At higher frequencies, the rate sensitive material contributes to the membrane's stiffness and thus extends the membrane resonance to a higher frequency ultimately increasing the range of frequencies with significant transmission loss.

Figure 13:
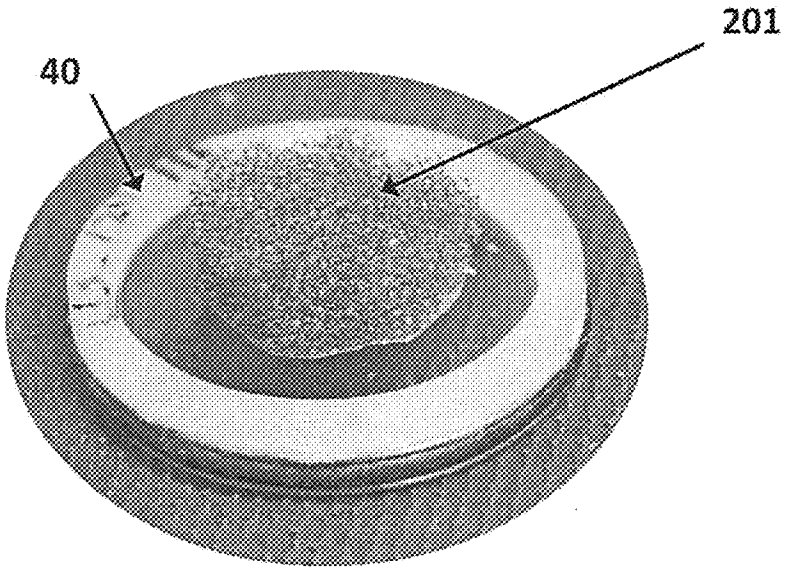
FIG. 13 depicts an alternative embodiment according to the principles of this invention.

In another embodiment, different damping materials may be used with the presently described embodiments to provide damping to the membrane structure 40 for improved absorption of acoustic energy. Referring to FIG. 13, a damping material 201 may be coupled with the membrane structure 40 to provide damping at the primary resonance point. In one embodiment, the damping material 201 (shown in FIG. 13) may be coupled with the mass 50 (not visible in FIG. 13) located at or near the center of the structure 40. In another embodiment, the damping material 201 may be coupled directly to the structure 40 instead of the mass 50 as described above. The material 201 may be, for example, foam, an open cell foam, fiber mats or similar absorption materials.

Figure 14A:
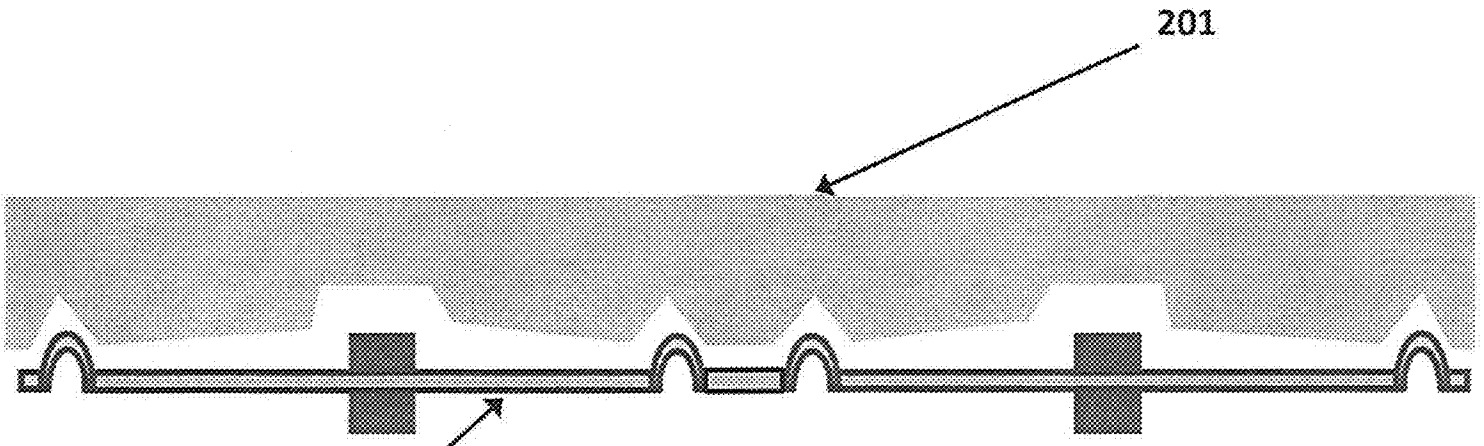
FIG. 14*a* is a cross section of two or more embodiments according to FIG. 13.
Figure 14B:
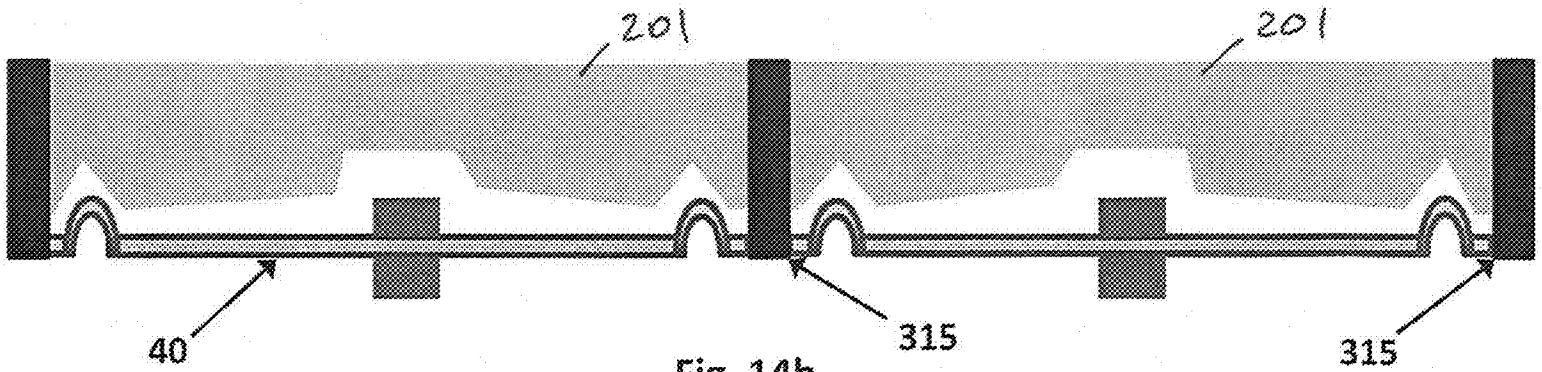
FIG. 14*b* is a cross section of two or more embodiments according to FIG. 13 with frame.

In another embodiment according to the present disclosure, the damping material 201 may be positioned adjacent to the membrane structure 40 for improved absorption of acoustic energy. Referring to FIG. 14*a*, the damping material 201 may be placed above one or more structures 40. Referring to FIG. 14*b*, one or more damping materials 201 may be placed above one or more structures 40, where each structure 40 is within a frame structure 315.

Figure 15:
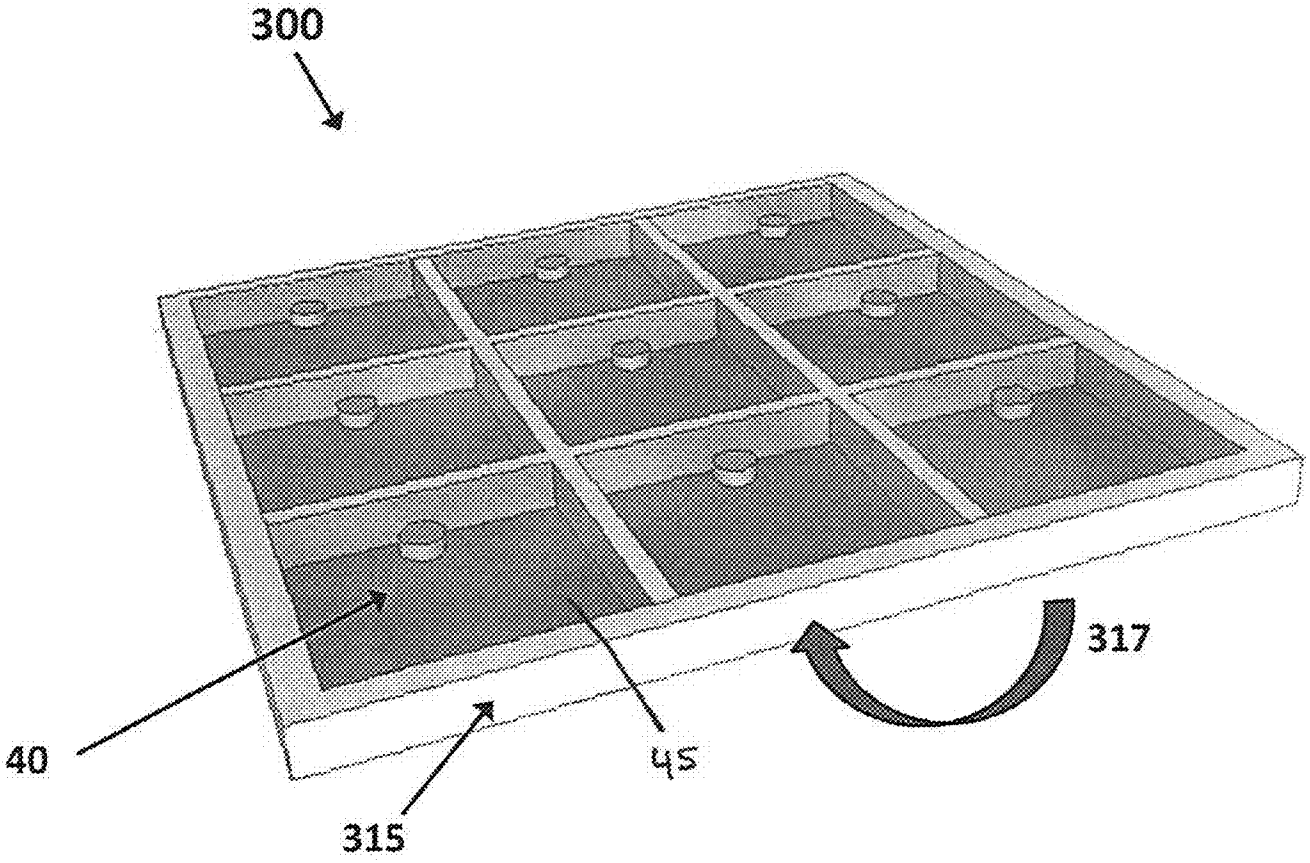
FIG. 15 depicts an alternative embodiment of the principles of this invention.
Figure 16:
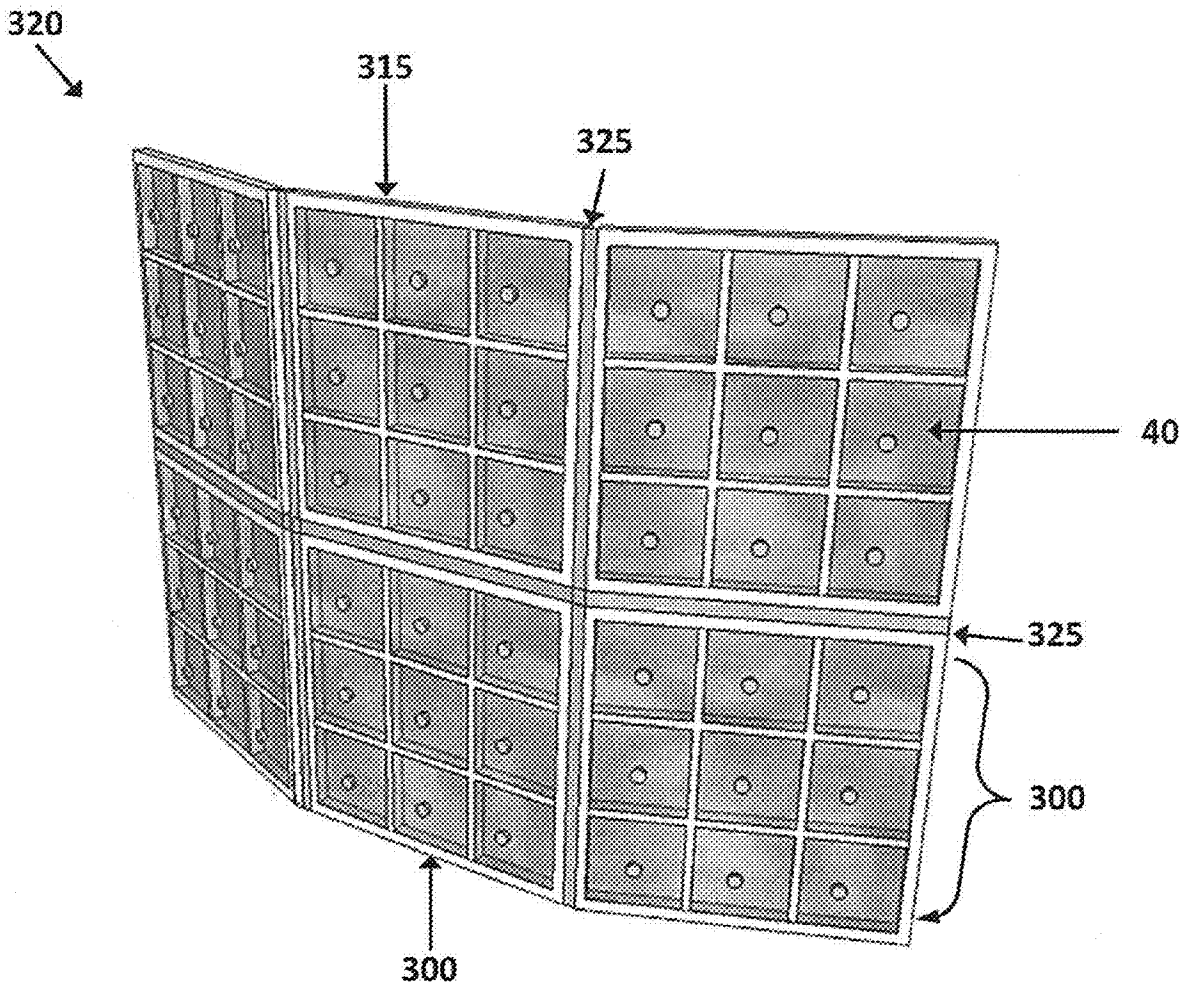
FIG. 16 depicts an alternative embodiment of the principles of this invention.

Referring to FIGS. 15 and 16, in one embodiment according to the present disclosure, a plurality of antiresonant membranes structures may be combined with a lightweight core along with lightweight framing structures 315 to form an acoustic tile 300 (shown in FIG. 15) that may be arrayed to form acoustic barrier panel 320 (shown in FIG. 16) to cover large areas and reject noise. One concern in providing antiresonant membranes larger than about 1.5 inches across is in the variation in performance with mass and size. For certain weight sensitive applications like in transportation, for example, using a large number of antiresonant membranes to cover a large area may result in an unacceptable weight penalty from the frames 315. Likewise, using a fewer number of membranes but larger in size may suffer from undesired resonant modes. To solve this problem, the presently described structures 300, 320 may use membrane 45 comprising rigid polymer films on one or both sides of an acoustic tile 300 that provides a significant increase in bending stability that thus prevents tile level vibration modes from destroying the acoustic energy attenuation effect. In one embodiment, the rigid polymer films comprise an elastic modulus greater than 1 GPa and comprise thickness of 0.001 inches to 0.01 inches. Further by engineering the rigid polymer membrane, the blocked frequency range may be tuned from very low ranges <100 Hz to very large ranges up to 5 kHz. Also using different resonant structures on each side of the acoustic tile 300 provides a significant increase in bandwidth and overall performance. Further by introducing a double antiresonant structure on one side with a singly antiresonant structure on the other side, even further increase in bandwidth may be obtained (for example, up to 8 octaves).

The acoustic barrier panel 320 (shown in FIG. 16) may be configured to control the flexural modal response with respect to the frequency range targeted by the antiresonant membrane 40. In one embodiment, good transmission loss performance is accomplished by configuring a combination of material stiffness and density along with grid member moment of inertia such that the fundamental ($1^{st}$ mode) grid resonance is more than 10% higher than the intended membrane 40 antiresonance frequency range. In another embodiment, good transmission loss performance is accomplished by configuring properties of the acoustic barrier panel 320 such that the membrane 40 antiresonance frequency lies between the $1^{st}$ grid mode and the $2^{nd}$ grid mode.

Returning to the basic design shown in FIG. 3, the previously mentioned weight penalty for area acoustic energy barrier tiles is solved at least in part by molding a plurality of membrane structures 40 as one unit as shown in FIGS. 14*a* and 14*b*.

In one embodiment, a lightweight acoustic tile as shown in FIG. 15 may be sandwiched by two thin engineered membrane layers to create tiles 300. These are then joined into various structures to cover large areas of structures and provide acoustic isolation. By engineering the acoustic tiles in combination with the engineered membrane layers on the upper and lower faces of acoustic tile 300, a large frequency span may be rejected. In FIG. 15 the upper engineered membrane is 315 and the lower engineered membrane is 317.

Figure 18:
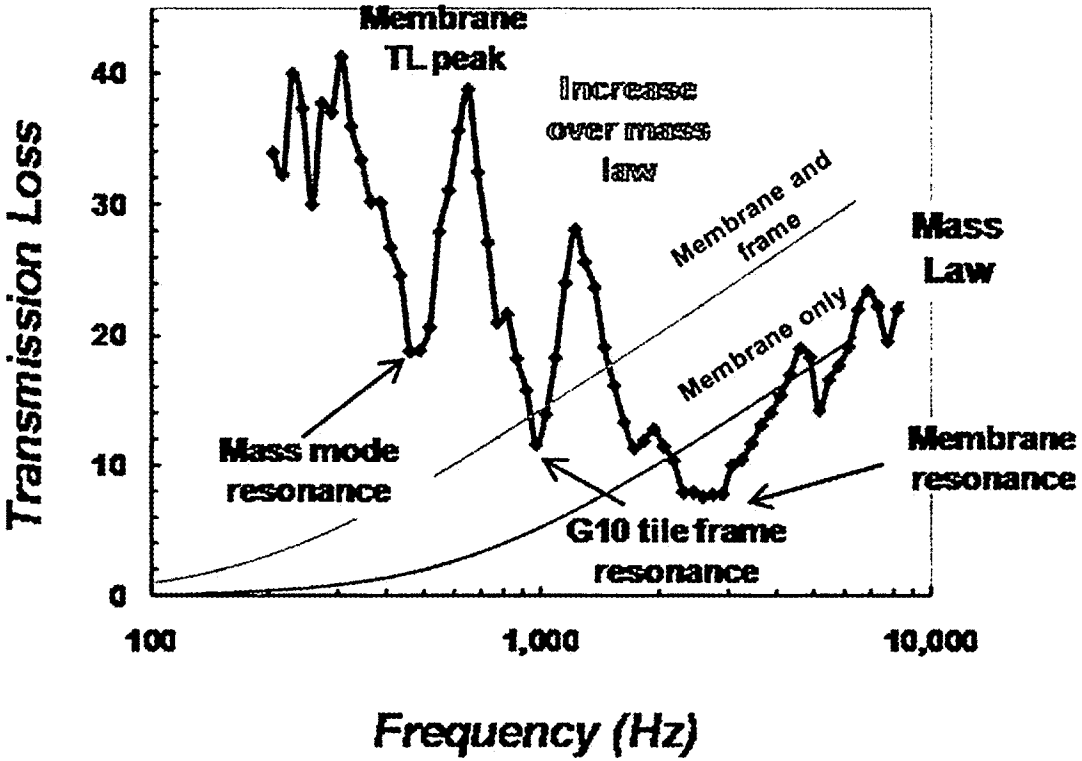
FIG. 18 depicts the transmission characteristic of the embodiment in FIG. 16.

In one embodiment, referring to FIGS. 15-16, the acoustic barrier 320 may comprise acoustic tiles 300 interconnected using a superframe 325. The acoustic tile 300 may comprise an array of membrane structures 40. Each membrane structure 40 acts as antiresonant system rejecting acoustic energy over a relatively broad frequency span. FIG. 18 shows transmission characteristic of the acoustic barrier 320. In one exemplary embodiment, the membrane structures 40 are one of or a combination of the structures described above with reference to FIGS. 3, 4*a-c*, 5, 7, 8, 9, 11. Each membrane structure 40 may be either square, hexagonal, triangular, or circular.

In one embodiment according to the present disclosure, membrane structures 40 may be placed on both sides of the acoustic tiles 300. The size of acoustic tiles 300 may vary between 2×2" and 2×2 ft and the shape may vary from square, rectangular, triangular, or hexagonal. The individual cell size will determine the number of cells in an individual tile between 2×2 and 15×15 cells per tile.

In another embodiment according to the present disclosure, different membrane structures 40 may be used for each side of the acoustic tiles 300 to increase the bandwidth of the acoustic reflection effect. For example, first side of the acoustic tiles 300 may comprise membrane structure 110 or 140, shown in FIGS. 8-9, and the second side of the acoustic tiles 300 may comprise any of the other membrane structures described above or known in the art. In this embodiment, the resonant center frequencies of the membrane structures on the second side of the acoustic tile 300 are engineered such that they complement the antiresonant center frequencies in the membrane structure 110 or 140 disposed on the first side of the acoustic tile 300.

In one embodiment, the frame 315 may comprise a softenable polymer, a shape memory polymer, or a polymer composite matrix with these materials reinforced with particulate or fibers or aligned fibers or fiber mats. By elevating the temperature of the superframe 325 material, the panel structure may be folded into place around a component or within whatever space is required then allowed to cool to restore its stiffness.

In one exemplary embodiment, openings may be provided for evacuation of air in the cavities formed between the adjacent membrane structures 40. Small slots or holes in the cell sidewalls may, for example, be used to provide this capability. Removing the air may prevent pressure build-up from altering the antiresonant behavior of the membrane structures 40. Removing air may also be used to tune the behavior of the resonant cavities.

The frame 315 may incorporate damping materials and surface elements including constrained layer damping treatments. Also, active vibration cancellation including piezoelectric patches and sensors may be used to damp vibration in the acoustic tile 300. The piezoelectric patches or membrane can be used to sense and thus responds to enable active or semi-active noise cancellation.

The acoustic tile 300 may be assembled together into the acoustic barrier 320 to cover large areas with minimal added mass. The acoustic barrier 320 may be fastened to substructure in a system or be isolated from the substructure. The acoustic barrier 320 acts as a boundary for the acoustic tiles 300. The acoustic tiles 300 may be rigidly attached to the frame 325 using adhesives or mechanical fasteners. The frame 325 may be composed of materials and structures with a high bending stiffness to weight ratio. For example, high aspect ratio beams, and shape cross sections such as I beams (shown in FIG. 17) and T beams (not shown) may be used for the frame 325. In one embodiment, the materials comprising frame 325 may include without implying a limitation: glass, carbon fiber reinforced polymer composites, aluminum alloys, steel alloys, magnesium alloys, as well as rigid polymers or particle reinforced polymers.

Figure 17:
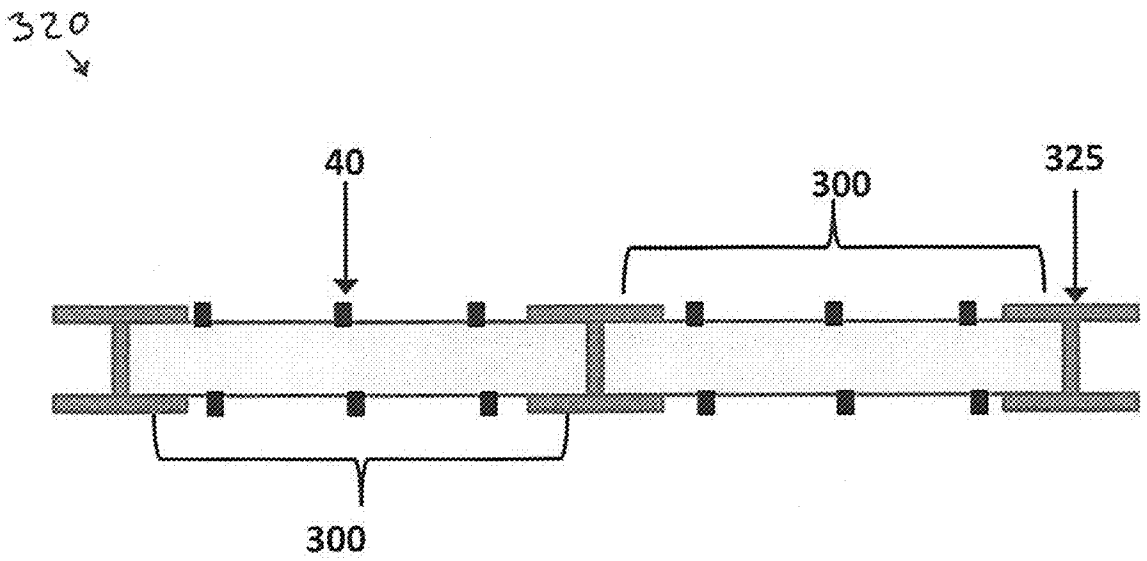
FIG. 17 depicts a cross section of an alternative embodiment of the principles of this invention.

Referring to FIG. 17, the acoustic barrier 320 may be fashioned such that the acoustic tile 300 are recessed into the frame 325 to provide a compact mounting solution and to add to the structural rigidity of the tile 300. FIG. 17 shows, without implying a limitation, an acoustic tile 300 comprising a three by three array of membrane structures 40. In one exemplary embodiment, the acoustic tile 300 may be mounted to the frame 325 using rigid fasteners (not shown) to eliminate relative motion between the acoustic tile 300 and frame 325. In another exemplary embodiment, the acoustic tile 300 may be mounted to the frame 325 using viscoelastic and soft elastomer mounting so that the frame 325 may be isolated from the acoustic tile's 300 vibrations thus reducing the transfer of the global frame vibrations into the acoustic tiles 300.

The acoustic barrier 320 may be fastened to a substructure to provide a rigid connection to the structure. Alternatively, vibration isolation mounts such as shear rubber type mounts may be used to mount the tile to provide isolation to the structure. For even greater control, the acoustic barrier 320 may be mounted to a structure using actively controlled mounts such as piezoelectric materials. These components in combination with an appropriate sensing, power, and control algorithm may provide a high degree of isolation for the tile from vibrations of the structure to which it is attached. This would be advantageous, for example, when the structure is undergoing vibration as in aircraft or rotorcraft in flight or cars during driving conditions as these structural vibrations can degrade the performance of the tile/frame solution.

Figure 19:
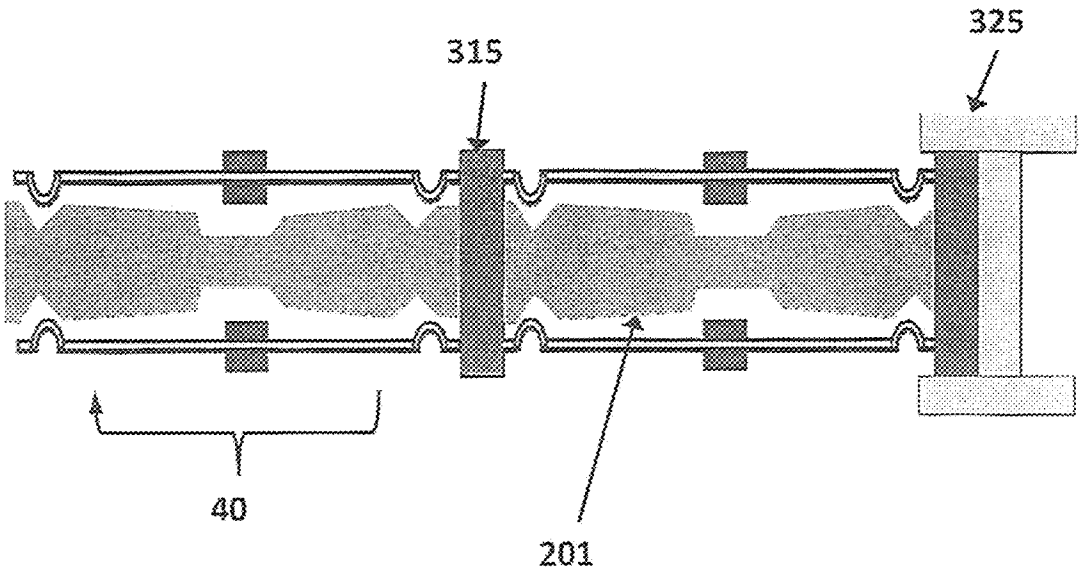
FIG. 19 depicts a cross section of a truss comprising a plurality of devices embodying the principles of the invention.

The performance of the acoustic barrier 320 may also be improved by incorporating viscous acoustic absorption materials such as foams and fiber mats or similar absorption materials. These materials may be incorporated in between the membrane structures 40 in a stack configuration as shown in FIG. 19 or before or after the membrane tile 300 to provide absorption at all frequencies and reduce transmission at high frequencies. This is may be important in applications where acoustic energy must not just be reflected away, but absorbed and converted into heat. This may reduce the echo and reverberation in interior spaces for example. The incorporation of these materials with membranes may be made such that the membrane still has space to vibrate freely. Since the amplitude of the center point is the largest. The space here must be greater than nearer to the edges. For this reason at the cell level the absorption material may have conical shape ideally, though a uniform gap between the absorber and the membrane is also acceptable.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. A membrane comprising:

a first weight disposed at a center portion of the membrane; and a first hinge structure disposed away from the center portion of the membrane.

2. The membrane of claim 1, further comprising one or more stiffening ribs extending away from the center portion of the membrane in a spoke pattern.

3. The membrane of claim 1, further comprising a second weight disposed between the first weight and the first hinge structure.

4. The membrane of claim 3, wherein the second weight defines an opening and the first weight is disposed within the opening.

5. The membrane of claim 1, further comprising:

a cover layer disposed above the membrane; and a viscoelastic material disposed between the membrane and the cover layer.

6. The membrane of claim 5, further comprising a second weight coupled with the cover layer.

7. The membrane of claim 1, further comprising a damping material coupled to the first weight.

8. The membrane of claim 1, further comprising a damping material disposed adjacent to the first weight.

9. The membrane of claim 1, wherein the first hinge structure defines an opening, wherein the first weight is disposed within the opening.

10. The membrane of claim 9, further comprising a second hinge structure disposed away from the first hinge structure.

11. The membrane of claim 10, wherein the second hinge structure defines an opening, wherein the first hinge structure is disposed within the opening defined by the second hinge structure.

12. The membrane of claim 1, wherein the first hinge structure comprises a semi-circular shape profile, a sine wave profile, triangular shape profile, or a square shape profile.

13. The membrane of claim 10, wherein the second hinge structure comprises a semi-circular shape profile, a sine wave profile, triangular shape profile, or a square shape profile.

14. The membrane of claim 1, further comprising a first surface disposed between the first hinge structure and the first weight, wherein the first surface is substantially perpendicular to a surface of the first hinge structure.

15. The membrane of claim 1, wherein the first hinge structure controls the stiffness of the membrane.

16. The membrane of claim 1, wherein the first hinge structure controls the resonant frequency of the membrane.

17. A structure comprising:

a first plurality of membranes, wherein each membrane comprises:

a first weight disposed at a center portion of the membrane;

a first hinge structure disposed away from the center portion of the membrane; and a first frame coupling the first plurality of the membranes.

18. The structure of claim 17, further comprising:

a second plurality of membranes, wherein each membrane comprises:

a first weight disposed at a center portion of the membrane;

a first hinge structure disposed away from the center portion of the membrane;

a second frame coupling the second plurality of the membranes; and a third frame coupling the first frame and the second frame.

19. The structure of claim 17, wherein at least one membrane of the first plurality of membranes is disposed above another membrane of the first plurality of membranes.

20. The structure of claim 19, further comprising a damping material disposed between the at least one membrane and the another membrane.

21. A method comprising:

providing a membrane;

forming a first hinge structure disposed away from a center portion of the membrane, wherein resonant frequency of the membrane depends on length, thickness, elastic modulus, or Poisson ratio of the first hinge structure.

22. A membrane comprising:

a first weight disposed at a center portion of the membrane; and one or more stiffening ribs extending away from a center portion of the membrane in a spoke pattern.

23. A membrane comprising:

a first weight disposed at a center portion of the membrane; and a second weight disposed between the first weight and an outer portion of the membrane, wherein the second weight defines an opening and the first weight is disposed within the opening.

24. The membrane of claim 23, wherein the second weight is ring shaped.

* * * * *